United States Patent [19]

Walsh

[11] 4,380,412

[45] Apr. 19, 1983

[54] LAP SHAPING MACHINE WITH OSCILLATABLE POINT CUTTER AND SELECTIVELY ROTATABLE OR OSCILLATABLE LAP

[75] Inventor: Thomas A. Walsh, Santa Ana, Calif.

[73] Assignee: R. Howard Strasbaugh, Inc., Huntington Beach, Calif.

[21] Appl. No.: 63,036

[22] Filed: Aug. 2, 1979

[51] Int. Cl.[3] ..... B23D 7/10

[52] U.S. Cl. ..... 409/314; 51/58

[58] Field of Search ..... 51/58, 160, 162; 82/12; 409/314-316

[56] References Cited

U.S. PATENT DOCUMENTS

| | | | |
|---|---|---|---|
| 1,199,519 | 9/1916 | Arnold | 51/58 |
| 1,221,858 | 4/1917 | Hollands | 51/58 |
| 1,309,264 | 7/1919 | Squier | 51/58 |
| 1,580,006 | 4/1926 | Brown | 409/314 |
| 1,803,429 | 5/1931 | Gunning | 51/58 |
| 3,782,042 | 1/1974 | Stasbaugh | 51/58 |
| 4,085,549 | 4/1978 | Hodges | 51/58 |

*Primary Examiner*—Harold D. Whitehead

*Attorney, Agent, or Firm*—Howard L. Johnson

[57] ABSTRACT

Programmable electric and hydraulic machine for shaping laps such as are used to form or polish opthalmic lenses, comprises vertically oscillatable, longitudinally displaceable arm carrying a point cutter which is functionally engageable by radially extensible, rotating lap carried by upstanding spindle. Alternately, spindle is operable by oscillating drive when lap is radially retracted. Toroidal or spherical laps having a large range of variance in two dimensions, i.e. curvatures, are thus obtained by using relevant cutter and lap locations, as well as appropriate drive settings. Concave laps are produced by exchanging locations of lap and cutter so workpiece is carried by vertical-moving arm.

9 Claims, 16 Drawing Figures

LAP SHAPING MACHINE WITH OSCILLATABLE POINT CUTTER AND SELECTIVELY ROTATABLE OR OSCILLATABLE LAP

BACKGROUND

Many ophthalmic laps in the past have been shaped or cut by a lengthwise oscillating, chisel-shaped scraper. These devices are accompanied by much vibration which, when reduced to a tolerable level, produces an undesirably slow operation.

More remotely, the lap was horizontally disposed atop a vertical spindle (which might be rocked or moved in a small circle) while a circle of lens blanks were rotated against the lap by a horizontal drive shaft.* Such spindle constructions are long gone.

*U.S. Pat. Nos. 1,201,833; 1,221,858; 3,352,066.

Attempts have been made to design a device wherein either the lap or tool could be coupled to the side of a high speed vertical spindle. However making the lap or its carrying spindle radially positionable, imparts more instability to the whole assembly. Also, close positioning of the lap to the spindle axis (so as to produce a steep-radius curve on the lense) may result in the rear of the lap holder abutting the cutter when rotation is attempted.

SUMMARY OF THE INVENTION

The invention provides a frame or base with two interacting positioning units having respective pivot axes aligned perpendicular to each other (e.g. one horizontal and the other vertical), each unit having means for detachable coupling of a tool e.g. cutter or a workpiece e.g. lap at a selected, calibrated location disposed radially outward from its axis, such location thereby effecting the resultant pattern of surface curvature produced on the lap by the cutter. One attachment is oscillated vertically (from the horizontal axis) in intermittent contact with the other attachment, which latter is usually rotated continuously, but alternately may oscillate (when the workpiece is held close to the spindle). In addition, (for initial setting) one complete positioning unit is displaceable along a calibrated path which is perpendicular to the common plane of the two axes (thus determining the major axis of curvature of the workpiece). However the two axes as a unit may be tilted in either direction as long as they remain 90° apart.

A triangular, replaceable, tungsten carbide cutter, such as commercially available for use with lathes, is carried by a clapper box mounted at the end of a curved arm which is cyclically movable arcuately downward on the horizontal axis for the lap cutting stroke or advance. The cutter makes a succession of such transverse cuts across the face of the workpiece synchronously with successive rotations (or oscillations) of the lap past the cutter. The downward motion of the cutter is thus sufficiently slow (relative to either rotational or oscillative motion of the lap) so that such successive such cuts form a smooth, continuously shaped surface on the workpiece.

The clapper box mounting arm is connected to a lengthwise variable, support arm which latter is pivoted on the horizontal spindle, oscillatable about its axis by means of a fluid-balanced rack and pinion drive. Oscillation of the support arm is achieved through reciprocation of the rack by means of a hydraulically actuated piston. The arm and spindle is thereby partially rotated in one direction to impart an arcuate downward motion to the cutting tool. The spindle is then arced back in the opposite direction to impart a corresponding (non-functional) upward displacement e.g. retraction of the tool to a position appropriate for the beginning of another cutting stroke. The lengthwise variable, radial support on which the curved mounting arm with clapper box is mounted, provides the means for positioning the cutter at selected displacements from the horizontal axis of rotation. Such radii determine the vertical radius (minor axis curvature) of the lap. Alignment of the horizontal and vertical axes (in the same plane) produces spherical shaped laps, i.e. having the same horizontal and vertical radii. Horizontal displacement of the vertical spindle from this plane produces toroidal shaped laps when the horizontal radii are different from the vertical radii. Length of the oscillative stroke of cutter is determined by setting of a pair of contact cam plates which are alternately touched by a dependent microswitch probe carried by the support arm.

From an electric motor, alternate drive trains are connectable to the vertical spindle to effect either continuous rotation or arcuate oscillation. Each potential drive path contains a bearing ring or raceway, either one of which must be bypassed or bridged to make the selected drive functional. Clutch means to effect this purpose are axially shiftable between alternate positions along a dependent splined portion of the vertical spindle.

By the circuitry provided, the cutter arm is retracted at a faster rate than the driving stroke which is adjustable and typically ½" to 3" per minute. With a two speed motor, the lap may be rotated at a low speed of say 152 RPM to a high speed of 235 RPM.

The assembly includes minute alignment means, which settings can be related to lens curvature in diopters. Also, concave instead of convex laps can be produced simply by changing the positions of the coupled tool and workpiece, that is, by attaching the cutter to the spindle and mounting the lap on the oscillating arm.

DETAILED DESCRIPTION OF PREFERRED EMBODIMENT

Figure 1:
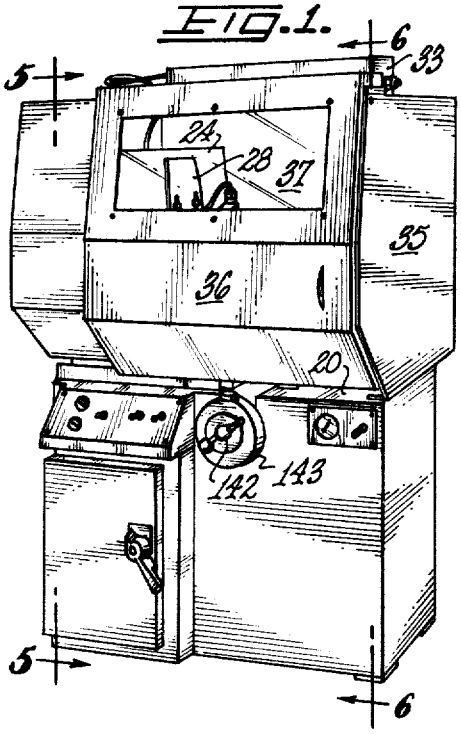
FIG. 1 is a perspective view of the lap shaping machine with the protective head cover closed.

The assembly or machine (FIG. 1) is a self-contained unit which may be placed on the floor of a workplace and connected to an outlet for electrical current and compressed air (for operating the drive motor and air/-hydraulic accumulators). A housing cabinet provides a rectangular work area defined primarily by a horizontal surface 20 (FIG. 2) having the height of a workbench, above which a rotary table 22 is dependently supported, as hereafter detailed. A vertical wall 24 is spaced inward from an end plate 26 of the housing, and is penetrated by a fixed horizontal conduit 25 (FIG. 7) which journals the ends of a rotary shaft 38 having an annular pivot head 27 projecting into the work area where it supports a programmable tool carrying unit A. A pair of flat cam plates 28, 30 (FIG. 6) are adjustably juxtaposed against the upright wall 24, each held by a pair of flanged bolts 29, 31 which traverse corresponding, vertically directed guide slots 32 of the respective plates. Upright rear 34 and end 35 walls further define the work enclosure area and the front is provided with a slidable cover or hood 36 having a transparent view area 37, plus cut-off switch 21 (FIG. 3) to sever the electric current to the machine when the hood is open. The cover is intended to prevent metal chips or cuttings from flying out of the work area, as well as preventing the operator from reaching in while the machine is operating. A fluorescent lamp 33 is carried along the top margin.

Figure 7:
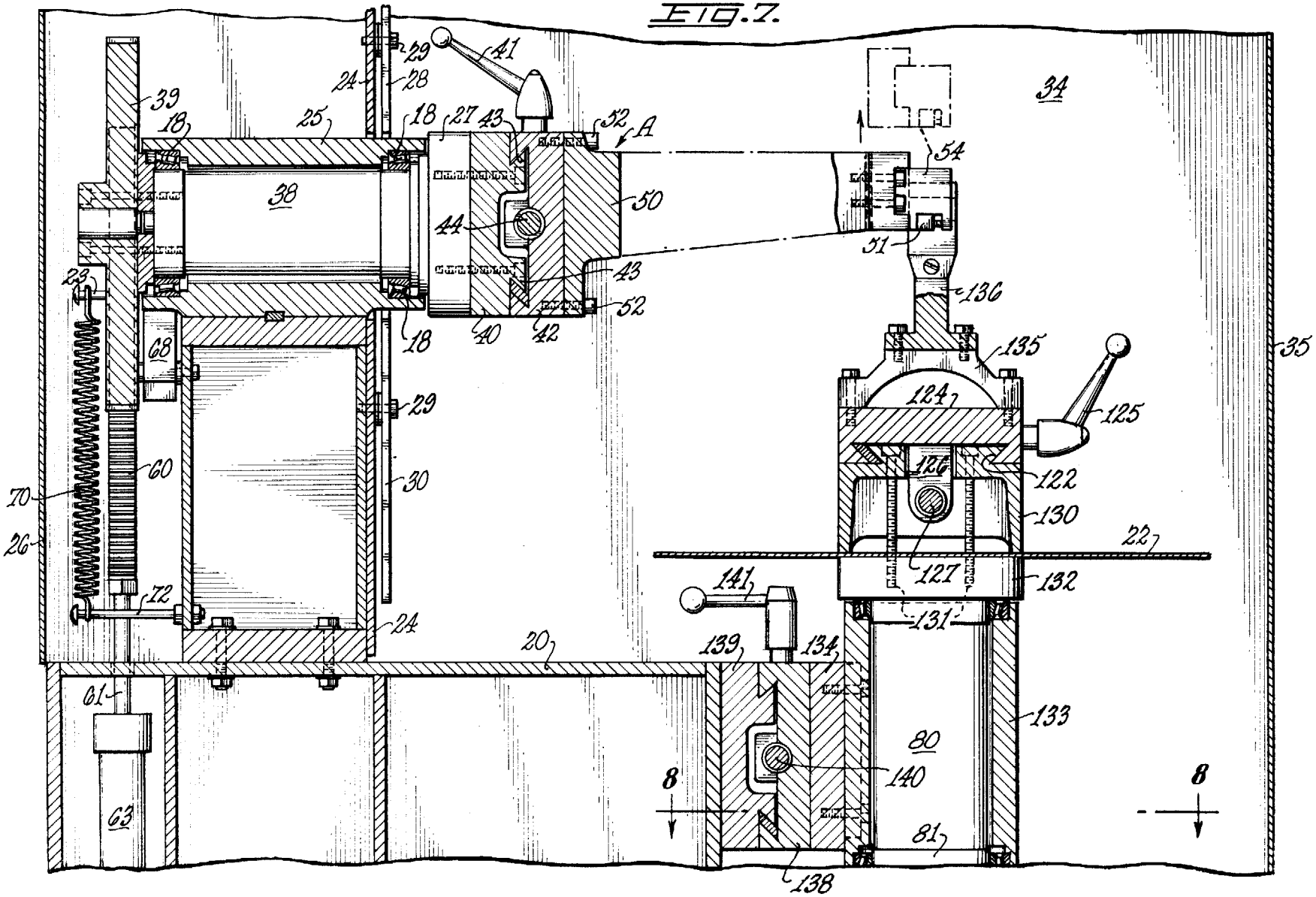
FIG. 7 is a vertical section taken along the line 7—7 of FIG. 6 with the detached clapper box shown in phantom.
Figure 15:
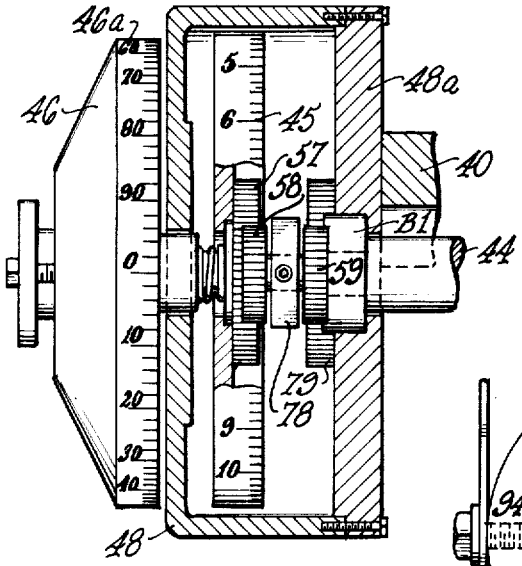
FIG. 15 is a horizontal axial section taken along line 15—15 of FIG. 13, with some parts in elevation.
Figure 10:
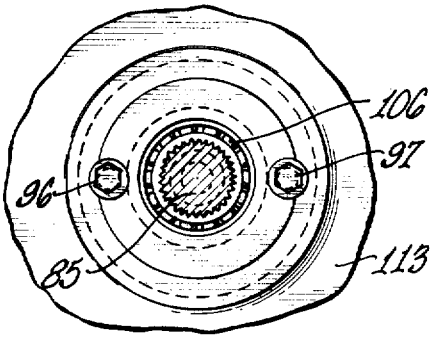
FIG. 10 is a horizontal section taken through the control end of the lap positioning unit along line 10—10 of FIG. 9.
Figure 11:
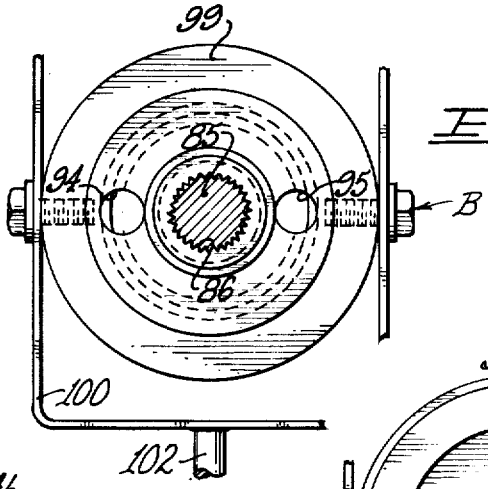
FIG. 11 is a horizontal section taken along the line 11—11 of FIG. 9.

The tool carrying unit A is wholly contained within the enclosable work area and consists of an elongated rectangular base 40 secured to the pivot head 27 of the horizontal, roller bearing (18) mounted shaft 38 (FIG. 7). In the work area it supports a carriage or support plate 42, lengthwise slidable along dovetail keyways 43. Along its underface it threadedly engages a worm shaft 44, the latter being manually driven or set by turning an end cap 46 by means of a handle 47. The slide plate 42 may be locked against movement by tightening a clamp handle 41. A cylindrical housing or shell 48 projects outward from the shaft and base 40 carrying a fixed lens-covered view site 49 beneath which is a circular scale 45 (FIG. 15) both carried by a reduced end-segment 44*a* of the shaft (FIG. 1).

Figure 13:
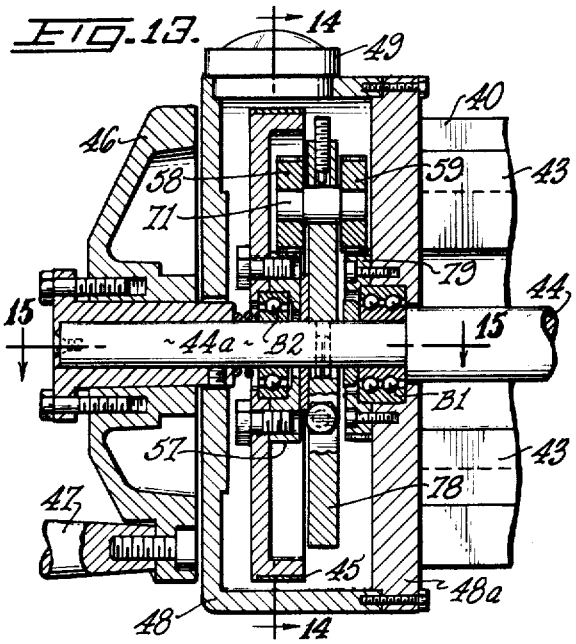
FIG. 13 is a vertical axial section of the control end of the cutter positioning unit.
Figure 14:
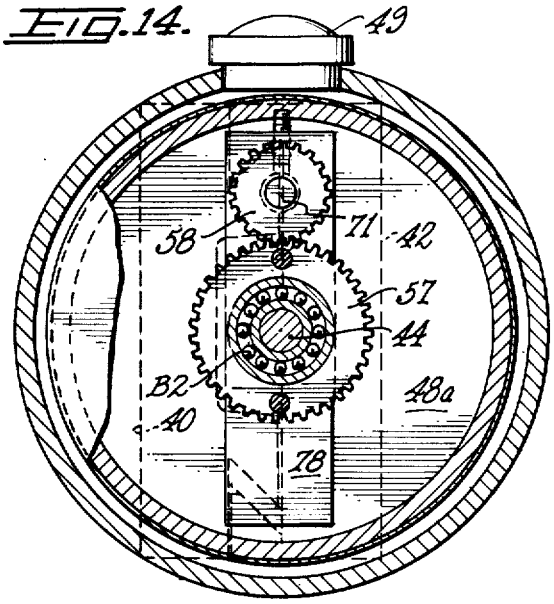
FIG. 14 is a transverse vertical section taken along line 14—14 of FIG. 13.

Vernier positioning means are provided for exact and easy setting of the cutter to obtain a desired diopter cutting. An annular band 46*a* of the cap 46 carries numerical indicia with the circumference divided into a hundred equal units and subdivisions. The inner face of the diopter scale disk 45 is fixed to a 50 tooth gear wheel 57 (FIG. 14) which meshes with a spur gear 58 which together with another spur gear 59 of the same size is carried on a spur shaft 71 which is journalled in a rectangular plate 78 carried by the reduced shaft 44*a*. The rear spur gear 59 meshes with a 51 tooth gear 79 which is fixed to the inner face of the rear wall 48*a* of the housing shell 48. Thus when the shaft 44*a* and cap 46 are rotated (by handle 47), the plate 78 and its carried spur gears 58, 59 are likewise rotated. The rear spur gear 59 rotates around the gear 79 (which is fixed to the housing wall 48*a*) and simultaneously the forward paired spur gear 58 drives the larger gear 57 (which is fixed to the diopter disk 45). Due to the small tooth difference (50:51) of the larger paired gears 57, 79, one rotation of the shaft 44*a* turns the diopter wheel only 1/50 of a revolution, or 7.2 degrees. Thus it requires fifty rotations of the shaft 44*a* (by plate 78 and handle 47) to effect one complete rotation of the diopter scale 45, thus making possible very fine calibration or adjustment. This result is possible because, of the terminal multi-structure shown in FIG. 13, only the plate 78 and cap 46 are fixed to the shaft 44*a*, and the remaining axial-based elements are mounted by way of the bearing assemblies B1 and B2. Since the diopter scale of disk 45 is non-linear, the 100 equal graduations of the band 46*a* are used in conjunction with a reference table or chart so as to render the initial diopter reading obtained from the disk 45, accurate to 0.001 inch.

Thus the curvature imparted to the lap surface in one direction depends on the forward position arrived at by the slide plate 42 (or more precisely by its carried tool 51) moving lengthwise along the screw 44, which position can be set or read in diopters. The upper face of the slide plate 42 carries an outwardly curved or bowed tool support arm 50, secured thereto by four bolts 52. Terminally the arm carries a removable, resiliently pivoted, clapper box 54 which functionally holds the cutter 51 rigidly when the arm is oscillated (clockwise) for the advance stroke, and retracted or "loose" on the return stroke. The right end of the laterally oscillatable base 40 carries a micro-switch 56 (FIG. 6) which operates to reverse the swing direction upon each contact of a rolling probe 55 made with the edge of the cam plate 28 or 30. Thus the reverse points and span of oscillation of the unit A (or its carried tool 51) is determined by the selected locations of the curved-edge cam plates 28, 30 as anchored along the slots 32.

The rotary shaft 38 at its outer end is drive-connected to a gear wheel 39 (FIG. 5) which engages an upright reciprocable rack 60 having a dependent rod 61 connected to a piston 62 within a fluid chamber 63 which is dependently anchored to the housing at 17. The drive chamber 63 contains hydraulic fluid adjacent each face of the piston; above it is connected by a conduit 64, through control valves FIG. 4, to an accumulator 65. Beneath the piston, the fluid is connected by a conduit 67, through shut-off valve HV, to an accumulator 66. The gear wheel 39 is driven part-turn clockwise (as viewed in FIG. 5) by the rack 60 and held in tooth engagement by the roller 69 of a support arm 68. The rack is connected at pivot 23 to a tension spring 70, terminally anchored to an attachment stud 72. The spring acts as a stabilizer to prevent cavitation in the hydraulic cylinder 63 which might otherwise occur if the arm 50 were manually forced down, thereby turning the gear wheel 39 and rack 60. Each accumulator 65, 66 has its central area filled through valve 53 with pressurized air or gas which is separated from the hydraulic fluid by a lengthwise, flexible wall or tube 19. The liquid is supplied by conduits 73, 74 having closure caps 75, 76.

Figure 9:
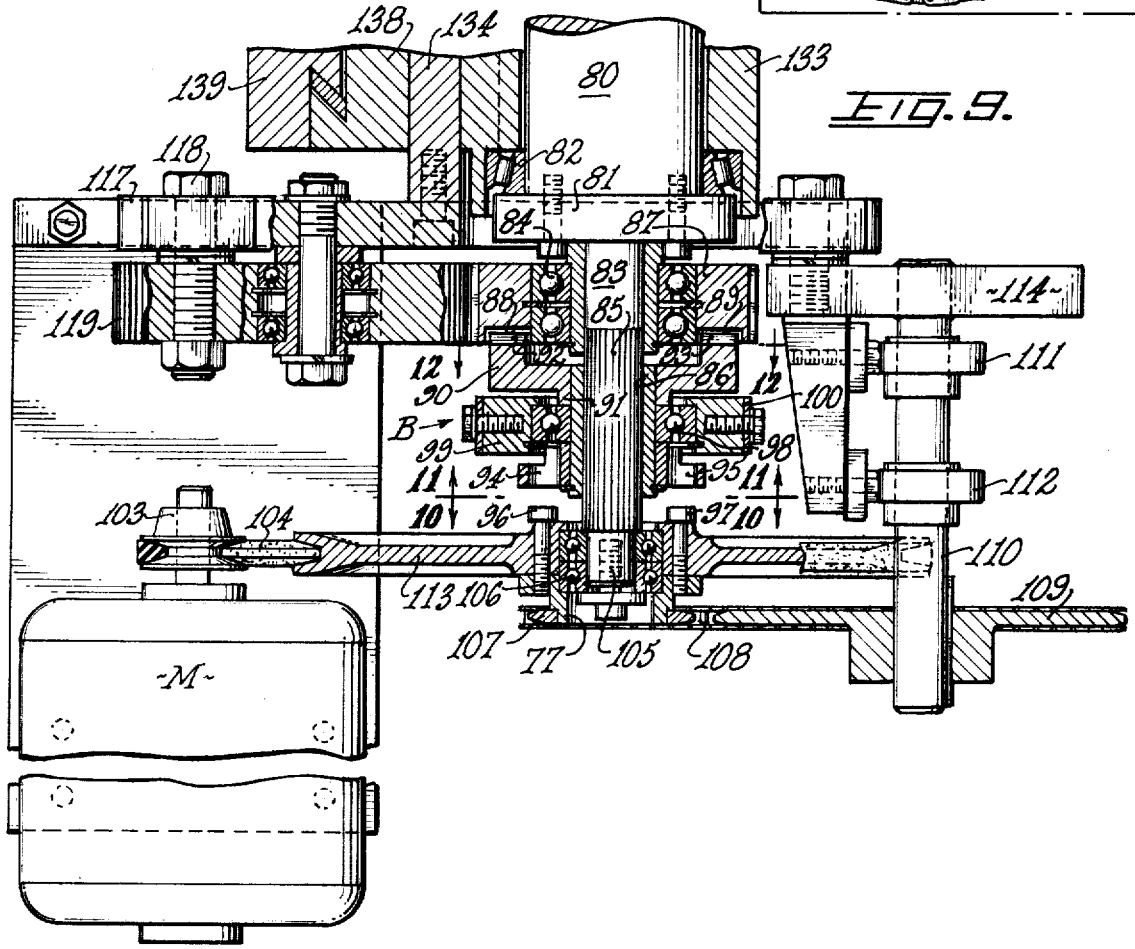
FIG. 9 is a vertical section taken along line 9—9 of FIG. 8.

The workpiece of lap L is attached atop a generally vertical spindle 80 (FIG. 9) having an intermediate, flared portion 81 which is disposed in a roller bearing raceway 82 and with a lower, axially restricted stem 83 located in a ball bearing raceway 84 and dependently disposing a splined or fluted length 85 in sliding contact with splines 86 of a clutch sub-assembly B. The outer portion of the ball bearing raceway 84 forms the core of an annular spur gear 87 which on its underface is formed with a diametric pair of thrust engagement sockets 88, 89. In the absence of such sockets being engaged by corresponding lugs below, the gear 87 is disengaged or free rotating.

Figure 2:
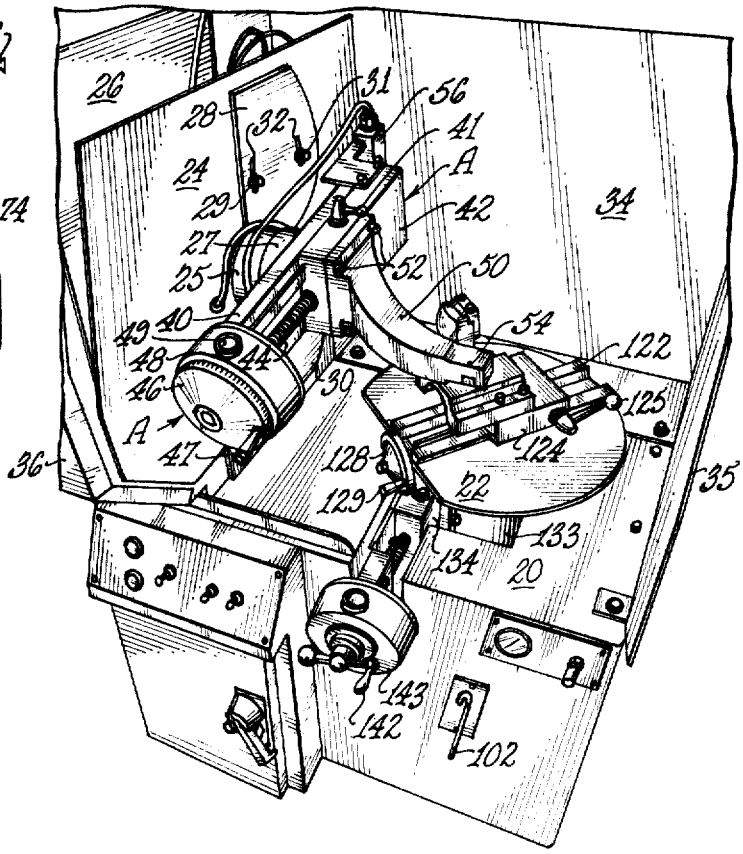
FIG. 2 is a perspective view looking down on the work area with the cover removed and the top and end wall partly broken away.
Figure 8:
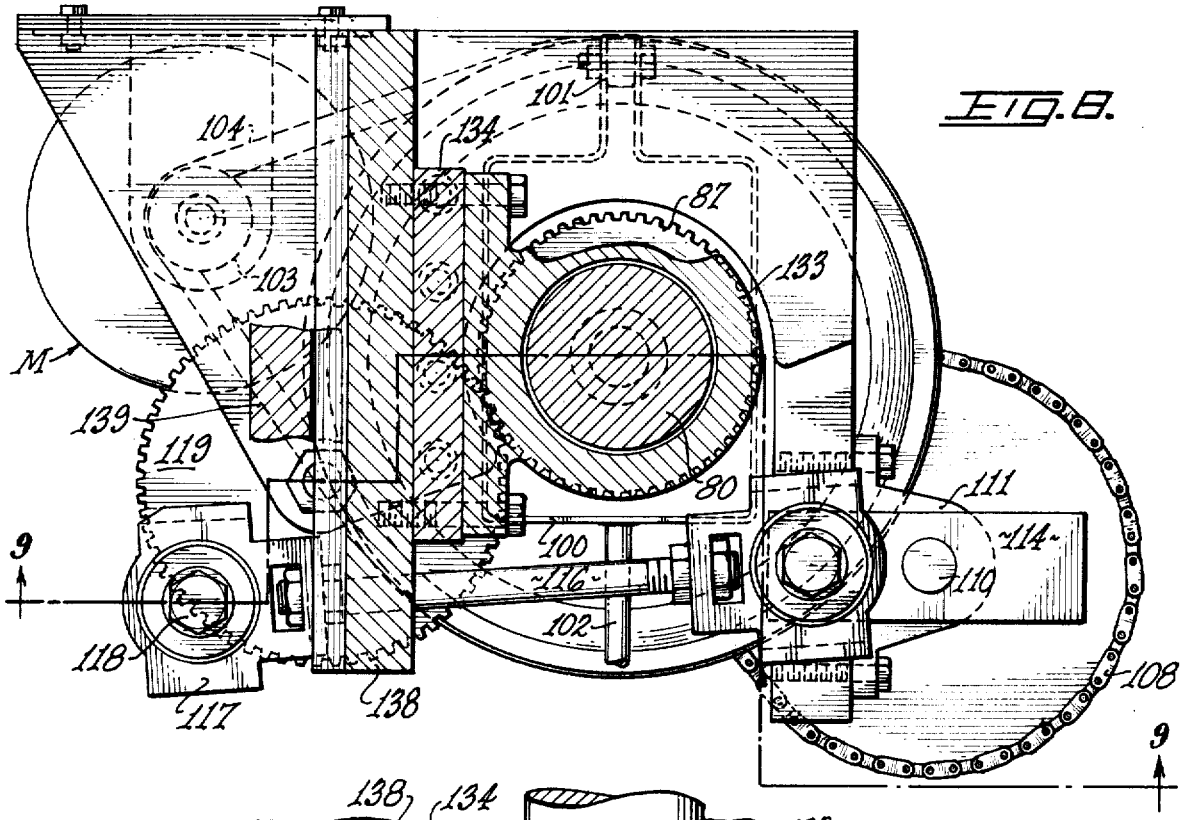
FIG. 8 is a horizontal section taken through the lower part of the machine along the line 8—8 of FIG. 7.

The clutch unit B consists of a two-tooth ring gear 90 having a dependent sleeve 91 to which splines 86 are fixed or formed integral. A pair of upthrust teeth 92, 93 of the ring 90 are located to drivingly engage the sockets 88, 89 when the unit B is slid up on the fluted length 85. The lower end of the sleeve is diametrically extended to provide a pair of downward opening sockets 94, 95 which are in vertical alignment with a lower pair of boltheads 96, 97 and engage the same when the clutch unit B is in "down" position. Between the ring gear 90 and the socketed portion 94, 95 of the sleeve 91, set off by the ball bearing raceway 98, is a collar 99 (FIG. 9) which is fixed to a yoke 100 (FIG. 8) hinged at 101 and having an outward projecting, operating handle 102 which is extensible through the housing (FIG. 2).

The shaft of an electric drive motor M (FIG. 9) carries a pulley 103, the belt 104 of which extends around a large pulley 113 which is centered about a terminal section 105 of the drive shaft (83) dependent from the spindle 80 and including the splined portion 85. A pair of ball bearing raceways 106 are disposed axially, intermediate the pulley 113 and the shaft section 105 and allow the splined portion 85 to be disengaged from the drive train by leaving open the sockets 94, 95. However a dependent hub or annulus 77 is formed terminal to the raceway 106 and carries a ring of sprocket teeth 107. The latter are engaged by a sprocket chain 108 which is led over a sprocket wheel 109 carried on a shaft 110. The rotary shaft 110, supported by bearing collars 111, 112, at its upper end carries a crank arm 114. The latter is coupled to one end of a transverse connecting rod 116 having its other end carried by a rod end-bearing 117 of which an axial bolt 118 oscillates a spur gear 119 (FIG. 9) which meshes with the axial ring gear 87. Thus it will be seen that (the yoke handle 102 in the UP position), when the toothed gear 90 engages the upper spur gear 87, the raceway 84 becomes bypassed and the whole coupled structure is rotated by pulleys 103, 113, 107, 109 and gear 87 in oscillation.

Alternately (the yoke handle 102 being in the DOWN position) when the sockets 94, 95 lock with the bolt heads 96, 97, the spindle and its shaft 83, 85 no longer become free-wheeling; the successive pulleys 103, 113 and 109 still drive the shaft 110, crank arm 114, and gears 119, and 87, but the latter is not now drive-connected to the spindle 80 because of the intervening raceway 84. In brief, use of the two-tooth gear or clutch 90 results in bridging the bearing raceway 84 so that a gear train can be formed going around it; alternate use of the socket coupling 94, 95 engagement with the boltheads 96, 97 bridges the bearing raceway 106 so that a gear train can be formed through it for the rotary drive of the spindle.

In other words, there are two broken or incomplete gear trains or drive trains, either one of which may be selectively completed: (a) from the drive pulley 113 directly through the clutch B to the spindle stem 83, 85, thus effecting continuous rotation of the spindle because the lower raceway 106 is bypassed or bridged by thrust engagement of the boltheads 96, 97 with the clutch sockets 94, 95; (b) when the upper raceway 84 is bypassed by formation of a drive train going around it and thus resulting in the oscillatory drive of the spindle drive gear 87 through reciprocation of the transverse rod 116. When both ends of the clutch unit B are disengaged, the drive train is broken or discontinuous through each raceway, 84, 106.

The rotary table 22 carried by the spindle 80 supports a dovetailed slide track 122 (FIG. 7) transverse or diametrically directed across its upper surface and carrying a horizontal slide plate 124 with locking clamp 125 and by a dependent tongue 126 threadedly engaging a worm shaft 127; the latter is manipulatable by an end cap 128 (FIG. 6) and handle 129 so as to move the slide plate. A slideway for the plate 124 is provided by an intermediate support 130 which is secured atop the table 22 by bolts 131 which fasten it to the annular head 132 of the spindle. The head 132 is fixed atop its solid shaft 80 which is contained within a bearing sleeve 133 which in turn is bolted to a vertical attachment plate 134. A support bracket 135 atop the slide plate 124 carries an upstanding (generally vertically projecting) work arm 136 which carries the lap or workpiece L. It will be seen that by turning the worm shaft 127 by the handle 129, the slide plate 124 is moved so as to locate the worm arm 135 and lap L a selected radial-outstepped distance from the axis of the spindle 80 (which position defines the depth of cut).

Figure 6:
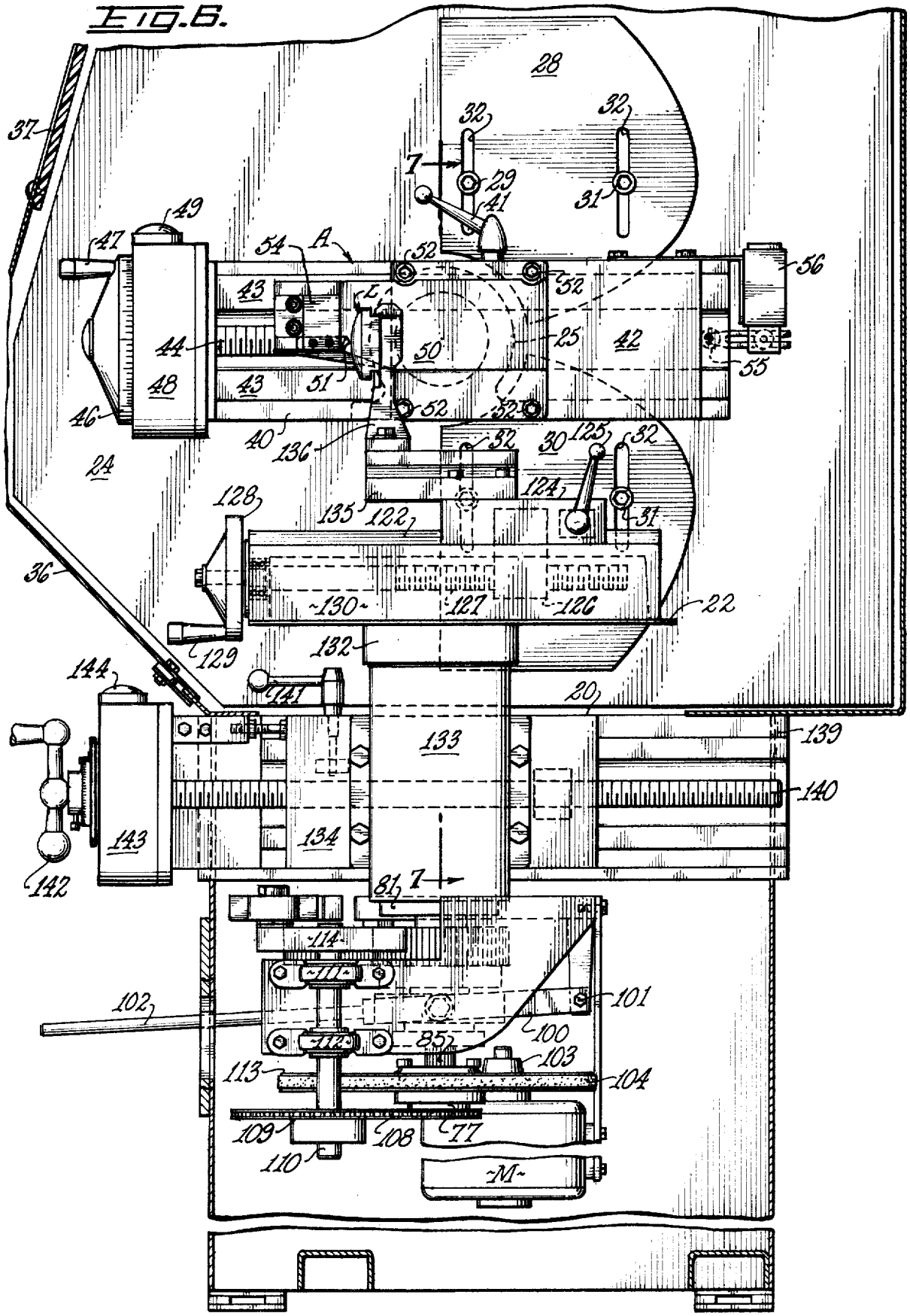
FIG. 6 is an elevational view of the other end as seen along the line 6—6 of FIG. 1.
Figure 16:
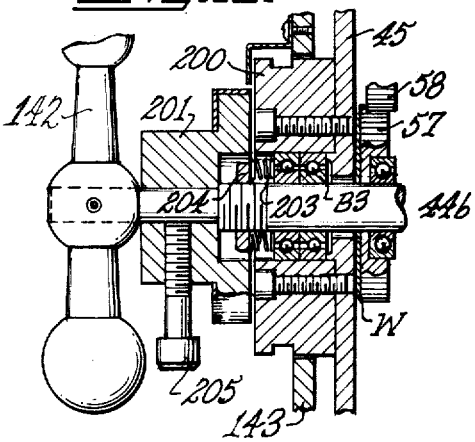
FIG. 16 is a partial vertical section of the control end of the lap holder positioning unit of FIG. 6.
Figure 12:
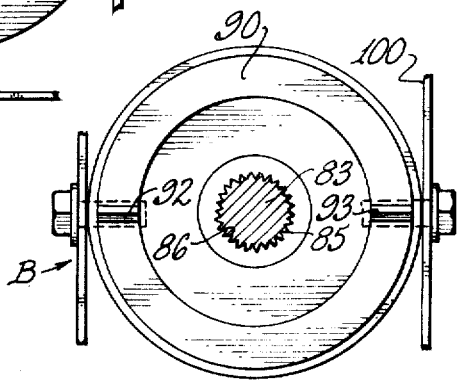
FIG. 12 is a horizontal section taken along the line 12—12 of FIG. 9.

In addition, the whole subassembly based on the spindle 80 is carried by a vertical or up-edged slide plate 138 to which the attachment plate 134 is fixed. The slide plate 138 is movable lengthwise along the slide track of a fixed support 139 by means of a dependently engaged worm shaft 140 which, as before, is manually rotatable by a terminal crank 142 (FIGS. 2, 6, 16). A drum shaped housing 143 projecting radially from the outer end of the support 139 carries a view sight or lens 144, and the slide plate may be locked at a selected position by a clamp 141.

Accordingly, the cutter arm 50 may be set at one position by the handle 47 and worm shaft 44 (thus defining one axis of curvature of the workpiece L). The crank 142 and worm shaft 140 can then dispose the spindle/rotary table 22 subassembly so that the axis of the spindle 80 lies on the same transverse (vertical) plane as the radius thus set for the cutter 51 (taken from the axis of the rotary shaft 38). The subassembly can then be moved along the alignment path of worm 140 back from this initial setting, which, together with the radial outstepping (by worm 127) of the workpiece from the rotary axis of the spindle 80 will define the second axis of curvature of the workpiece L and of its resultant lens.

By the construction of FIG. 16, the indicator wheel 45 is journalled on the reduced shaft **44*b* by the bearing assembly B3 and is bolted to the annulus 200 for joint rotation within the housing 143. The rear face of the central disc portion of 45 is frictionally engaged by a thrust washer W, sandwiched between it and the gear 57, the sub-unit being positioned along the shaft 44*b* by a nut 204 and tensioned by an axial spring 203**.

By this means, the indicator wheel 45 can be turned independently of the gear 57 thus to obtain a new initial or "zero" setting (which is not the case for the construction of FIGS. 13 and 15) from which any subsequent displacement can then be calibrated or read without preliminary calculation. Likewise the vernier scale around the annular surface of the cylinder 201 can also be set to zero by transiently loosening the bolt 205.

In retrospect, it will be appreciated that the anticipated problem of unbalance resulting from changing the location of the work support member 135 along the diametric path across the top surface of the spnidle 80 does not materialize due to the mass of the spindle and the (horizontal) spread of its flat top (or of the rotary table 22 which may extend further).

CIRCUITRY

In order to contour the surface of a workpiece or lap, the cutting tool must have a movement-component that is transverse to the lap surface, that is, sweeping it from one edge to the other. This movement is managed by an air/hydraulic circuit having a directional control-valve and a locking-valve, and by an electric circuit that provides suitable electric signals which selectively actuate and deactivate both the directional-control valve and the locking valve. As a result, the cutting tool is enabled to move in a selected direction, and to be locked against further movement when it has travelled a predetermined distance.

Figure 4:
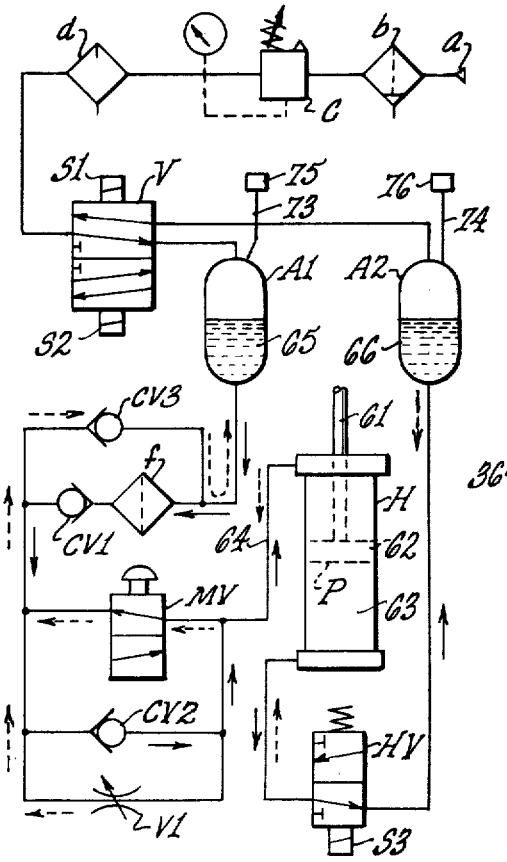
FIG. 4 is a schematic diagram of the hydraulic system.

In the present machine having a conventional clapper box 54, the cutter is "lowered" for (forward) driving or cutting stroke and "raised" for retraction or withdrawal, as inherent components of the total operation, which is represented in FIG. 4.

Figure 5:
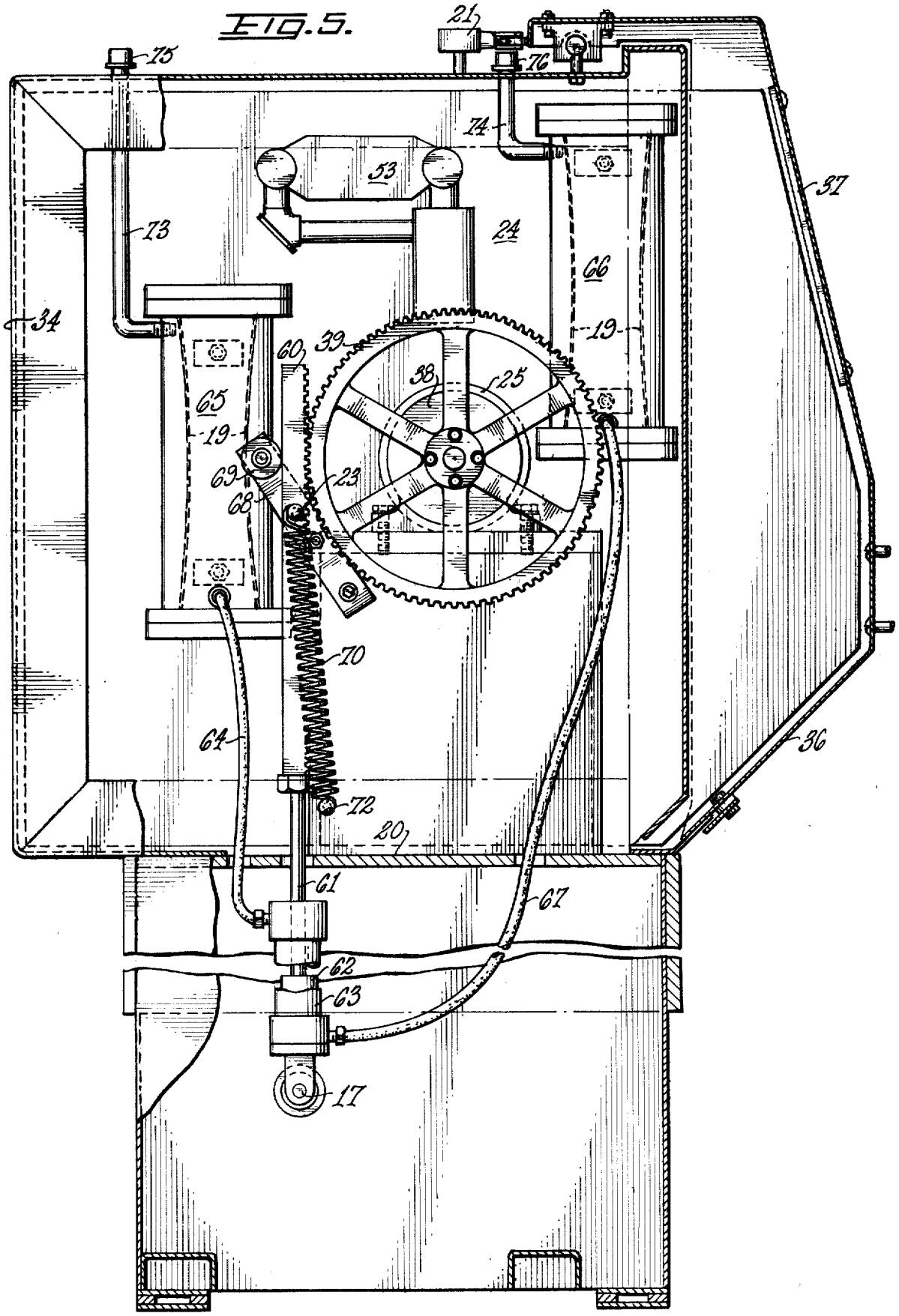
FIG. 5 is an end elevational view of the machine as seen along the line 5—5 of FIG. 1 with the end cover plate removed.

As shown, an air source a provides pressurized air (or other gas if available) that flows through a vapor filter b, through a pressure regulator c, a lubricator d, and then to a dual-ported gas-valve V. The two sections of this valve V are independently actuated by applying electric signals to solenoids S1 or S2 which selectively permit air pressure to be applied to either accumulator A1 or accumulator A2, which as hereafter explained, produce "downward" or "upward" movement respectively of a piston P in the hydraulic cylinder H. The cutting tool unit A and the tool itself are moved by means of a linkage (not shown) utilizing the piston shaft 61 of piston 62 (FIG. 5).

Specifically, when solenoid S1 of the direction-control valve V is energised by a suitable electric signal, the dual-ported valve V is actuated to a first state that permits pressurized air to flow into the upper portion of accumulator A1. The now pressurized accumulator A1 forces pressurized oil to flow out of the botton of Al, through oil filter f, check valves CV1 and CV2, to the "upper" portion of hydraulic cylinder H, thus causing piston P to move continuously downward.

The downward movement of piston P forces oil out of the "bottom" portion of cylinder H (63), through locking valve HV (which has been unlocked by an electric signal applied to solenoid S3 (this signal being coincident with the electric signal being applied to solenoid S1), and back to the second accumulator A2 or 66.

The linkage comprising piston shaft 61 moves the cutting tool positioning unit A (together with the tool 51) until a limit switch 56 (FIG. 6) abuts the edge of a cam plate 28 or 30 (depending on the direction of tool movement). Thereupon the limit switch terminates the electric signal applied to solenoid S1 (which thus stops tool movement), and also terminates the electric signal applied to solenoid S3 (which thus causes the locking valve HV to close and stop drainage of oil from the bottom of cylinder H, thereby locking piston P against further movement); and the tool support arm 50, by reason of its linkage between the cutter 51 and rotary shaft 38 plus valve 53, locks the cutting tool against further movement. This ends a rapid "retraction" stroke of the cutter.

Tool movement in the opposite direction is accomplished thus: Solenoid S2 of the directional control, duel-port valve V is energized by a suitable electric signal and valve V is actuated to a second state that permits pressurized air to flow into the upper portion of accumulator A2. This forces pressurized oil to flow out of the bottom of A2, through the now unlocked locking valve HV (unlocked by an electric signal applied to solenoid S3); this signal being simultaneous with the electric signal applied to solenoid S2 of valve V), to the bottom portion of cylinder H, causing piston P to move continuously upward. This forces oil out of the upper portion of cylinder H through a metering valve V1 (which permits only a predetermined rate of oil flow), through check valve CV3 and back to the bottom portion of accumulator A1. As before, the limit switch 56 is activated by contact with a cam plate 28 or 30. However this forward "cutting" movement of the tool is at a slow speed (because of valve V1) as compared to "withdrawal".

In some instances it is desired to move the cutter positioning unit A rapidly up to its work position, before operating at cutting speed. For this purpose, there is provided a manually operated bypass valve MV which, when activated, channels a flow of oil therethrough, so that the overall flow rate is the sum of that passed by the two valves V1 and MV.

Figure 3:
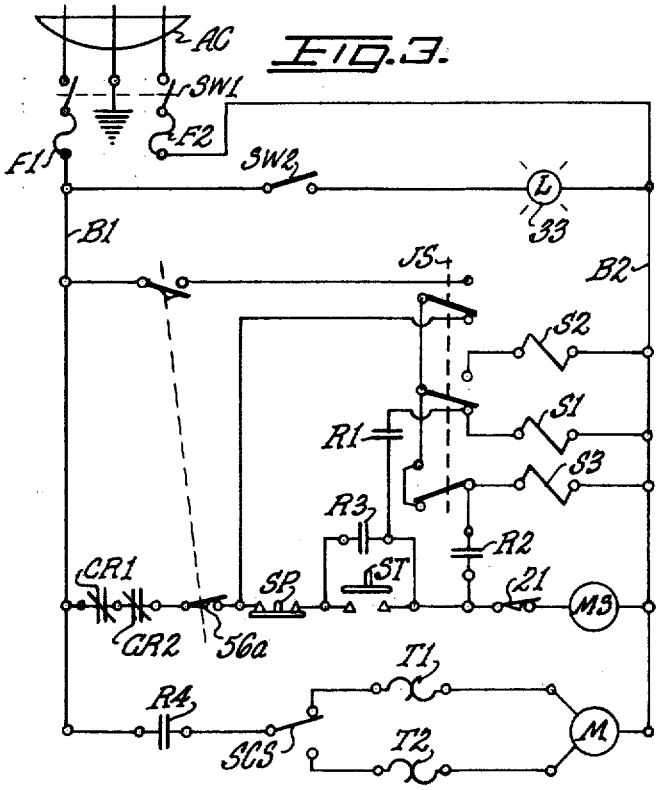
FIG. 3 is a schematic diagram of the electric circuitry.

The electric circuitry is shown in FIG. 3. Power from a suitable power source AC traverses a master switch SW1 and fuses F1 and F2, and is applied to bus bars B1 and B2. A switch SW2 controls the fluorescent lamp 33 or other illumination.

M is a two-speed spindle-drive motor, either of two typical speeds (1200 and 1800 RPM) being selectable by means of a speed-control switch SCS. Suitable thermal circuit-breakers T1 and T2 protect the motor M from overload and also, through normally-closed relay contacts CR1 and CR2, function to break the electric circuit when the motor is stopped because of an overload.

Thus normally-closed relay contacts CR1 and CR2 provide power through a limit-switch arm **56*a* to an emergency-stop switch SP, through a normally-open momentary start-switch ST, through door-interlock switch 21**, to a motor starter MS that controls the starting operation of the motor M.

A plurality of relay contacts R1, R2, R3, and R4 are connected in such a way that they are energized when the momentary starting-switch ST is closed. R3 is a latching contact that remains energized, thus the momentary closing of starting-switch ST completes the electric circuit to the motor-starter MS and to the motor M.

As seen in FIG. 4, in order to provide downward movement of the piston P, it is necessary to provide coincident electric signals that energize or actuate solenoids S1 and S3, the former initiating piston-movement and the latter unlocking valve HV. For this purpose, a three setting, momentary jog-switch JS of FIG. 3 is set to its "lower" setting; this causes the limit-switch arm **56*a* to provide power through jog-switch JS to solenoids S1 and S3. As a result of this set of electric signals, the piston P of FIG. 4 moves downward as previously noted, until the limit-switch abuts one of the cam plates (28, 30). At abutment, the limit-switch arm 56a is opened, and the limit switch arm 56b is closed. The now open limit-switch arm 56a** terminates the above discussed set of electric signals to solenoids S1 and S3, so that movement of piston P is terminated, and it is locked against further movement.

Referring again to FIG. 4, in order to provide upward movement of piston P, it is necessary to provide a second set of coincident electric signals that actuate solenoids S2 and S3, the former initiating upward piston movement and the latter unlocking valve HV. In order to provide this second set of signals, jog switch JS is set to its upper setting, causing power to be applied through now-closed limit switch arm 56b to solenoids S2 and S3. As a result, the piston P moves upward until the limit-switch 56 abuts the other of the cam plates. At abutment, the limit switch is actuated and the arm 56b is opened, the other arm 56a being closed. The open arm 56b terminates the second set of electric signals so that piston movement of P is terminated and locked against further movement. Thus the jog-switch JS controls the direction of movement of the piston P and thus controls the movement of the cutting-tool unit A and of the cutter 51. Because of the linkage to the piston P, the actual movement of the cutter is in the opposite direction to that of the piston P.

As indicated above, motor overheating or overloading will disable the electric circuit and an emergency stop-switch SP may do the same. However, the up-position of the jog-switch will still be operable because it does not get its power from either of these. Since relay R3 is a latching relay, either of the emergency stops will deenergise the latching relay R3, and a manual start will then be necessary.

I claim:

1. A lap surfacing machine useful for forming laps such as employed in the production of ophthalmic lenses, comprising a support base having a pair of individually adjustable positioning units adapted, in operation, to dispose a rotatable lap and a unidirectionally operable cutter in intermittent functional engagement, the first of said positioning units comprising a generally upstanding spindle, means for selectively attaching a lap or cutter to said spindle in position of selected radial displacement for rotation in unison therewith, the second of said positioning units comprising an elongated arm, arcuately swingable on a pivot axis disposed generally transverse to said spindle, and distally having attachment means for selectively carrying either a cutter or a lap, drive means for pivotal oscillation of said arm on its pivot axis whereby said distally carried cutter or lap may functionally engage the moving lap or cutter of the first positioning unit, and drive means for said first positioning unit including shift means for selectively continuously rotating said spindle and for oscillating the spindle synchronously with oscillation of said arm.

2. A machine according to claim 1 including fluid circuit means for effecting oscillative movement of the arm of said second positioning unit at different speeds respectively for advance and withdrawal of its carried cutter.

3. A machine according to claim 1 wherein said carried unit is formed with an internally threaded bore and the calibrated shift means includes a worm shaft traversing the bore of said carried unit for threaded movement therealong, an encircling band of indicia carried by said unit, calibrated relative to longitudinal displacement of the unit along the worm shaft and rotatable jointly therewith, and reset means operable at any rest position of said carried unit for releasing said band and returning it to a zero position relative to the worm shaft for measurement of subsequent movement of said worm shaft.

4. A machine according to claim 1 wherein said attachment means are selectively locatable lengthwise along said elongated arm, and including means for limiting the arcuate extent of swing thereof relative to the lengthwise location of the attachment means therealong.

5. A lap surfacing machine useful for forming laps such as employed in the production of ophthalmic lenses, comprising a support base having a lap positioning unit and a cutter positioning unit adapted, in operation, to dispose a rotatable lap and a oscillatably slidable, unidirectional cutter in intermittent functional engagement, the lap positioning unit comprising a generally upstanding spindle, means for detachably securing a lap alongside thereof, means for selective radial displacement of said lap from the axis of said spindle for rotation in unison therewith, drive means for continuously rotating said spindle, and clutch means for effecting, alternate to continuous rotary movement, selective oscillative movement of the spindle, whereby in either event the cutter and carried lap may be disposed in unidirectional functional engagement, said spindle having an axially dependent, splined shaft, a pair of rotational drive members disposed by intermediate bearing rings adjacent respective ends of said shaft, each of said members forming part of an incomplete drive train effective respectively for continuous rotational drive and reciprocable arcuate oscillation of said spindle upon completion of the particular drive train, said clutch means being selectively movable axial to said splined shaft between alternate positions for actuating a selected drive train, by bridging one of said bearing rings and thus completing its drive train, the cutter positioning unit including an arcuately toothed member supporting a radially extending arm terminally carrying an abrasive point cutter disposed functionally to transversely sweep the face of said moving lap, a rack disposed in driving engagement with the arcuately toothed member, and fluid drive means for reciprocable movement of said rack whereby said toothed member and carried cutter are reciprocably moved, the cutter positioning unit and the lap positioning unit each being carried by a respective spirally threaded shaft along which the cutter or lap is selectively displaceable, and additionally at least one of said spirally threaded shafts with its carried unit is carried on calibrated shift means for selective displacement to a rest position along a transverse path of said base, thus further effecting by location at such rest position the curvature subsequently cut on said lap.

6. A lap surface machine useful for forming laps such as employed in the production of ophthalmic lenses, comprising a support base having a pair of individually adjustable poistioning units adapted, in operation, to dispose a rotatable lap and a unidirectionally operable cutter in intermittent functional engagement, the first of said positioning units comprising a generally upstanding spindle, means for selectively attaching a lap or cutter to said spindle in position of selected radial displacement for rotation in unison therewith, the second of said positioning units comprising an elongated arm, arcuately swingable on a pivot axis disposed generally transverse to said spindle, and distally having attachment means for selectively carrying either a slidable cutter or a lap, drive means for pivotal oscillation of said elongated arm on its pivot axis whereby said distally carried cutter or lap may functionally engage the moving lap or cutter of the first positioning unit, said spindle including an axially extending, splined length and being journalled by a pair of bearing raceways spaced apart along the splined length, a rotational drive member carried by said shaft proximate to each raceway, each of said drive members forming part of an incomplete drive train for effecting respectively continuous rotation and arcuate oscillation of the spindle, and an annular clutch carried by said splined length and selectively displaceable therealong between the bearing raceways, said clutch having means adjacent each end thereof for thrust engagement with one of said rotational drive members thereby to bridge the adjacent raceway and complete the particular incomplete drive train for effecting rotation or oscillation of the spindle.

7. A machine according to claim 6 including fluid circuit means for controlling the oscillative movement of said cutter at different speeds respectively for cutting and withdrawal moves, including a hydraulic cylinder having a rack-connected piston disposed therein, first and second fluid accumulators each containing both pressurized gas and hydraulic fluid, the hydraulic fluid thereof being conduit-flow-connected respectively to said hydraulic cylinder adjacent opposite faces of said piston, means comprising a two-state, dual-port, direction-control-valve for causing said first and second accumulators to produce respective cutting and withdrawal moves of the cutter, means comprising a locking valve for hydraulically locking the cutter against movement, metering valve means for regulating the speed of movement of the cutter in one direction and by-pass valve means for causing a more rapid movement of the cutter in the opposite direction.

8. A machine according to claim 7 wherein said locking valve normally locks said cutter from movement, comprising control means responsive to a predetermined movement of said arm in one direction for setting said control valve for one of said speeds and for releasing said locking valve, said control means being responsive to a predetermined movement of said arm in the opposite direction for setting said control valve for a different speed and for releasing said locking valve.

9. A machine according to claim 8 wherein said control means comprises selectively settable switch means settable in one condition to effect setting of said control valve for one of said speeds and settable in another condition to effect setting of the control valve for a different speed.

* * * * *